US008215507B2

(12) United States Patent
Dubs et al.

(10) Patent No.: US 8,215,507 B2
(45) Date of Patent: Jul. 10, 2012

(54) SEALING SYSTEM AND METHOD FOR SEALING CONTAINERS

(75) Inventors: Hans-Dieter Dubs, Worms (DE); Peter Seidel, Over-Florsheim (DE); Jurgen Soldan, Worms (DE)

(73) Assignee: Alcoa Deutschland GmbH (DE)

( * ) Notice: Subject to any disclaimer, the term of this patent is extended or adjusted under 35 U.S.C. 154(b) by 0 days.

(21) Appl. No.: 12/569,111

(22) Filed: Sep. 29, 2009

(65) Prior Publication Data

US 2010/0012614 A1 Jan. 21, 2010

Related U.S. Application Data

(63) Continuation of application No. 10/560,948, filed as application No. PCT/EP2004/005456 on May 21, 2004.

(30) Foreign Application Priority Data

Jun. 16, 2003 (DE) ..... 103 28 179

(51) Int. Cl.
*B65D 41/34* (2006.01)

(52) U.S. Cl. ..... 215/252; 215/44

(58) Field of Classification Search ..... 215/43, 215/44, 252, 354, 355
See application file for complete search history.

(56) References Cited

U.S. PATENT DOCUMENTS 807,381 A 12/1905 Hicks
1,796,729 A * 3/1931 Niver et al. ..... 215/230
2,069,075 A * 1/1937 Lunn ..... 215/295
2,113,176 A 4/1938 Fabrice
2,124,873 A 7/1938 Conner
2,141,856 A 12/1938 Fabrice
3,314,564 A * 4/1967 Andersen et al. ..... 215/252
3,601,273 A * 8/1971 Kutcher ..... 215/252
3,910,443 A 10/1975 Hadley
4,385,707 A 5/1983 Leiter
4,448,318 A * 5/1984 Lowe ..... 215/252
(Continued)

FOREIGN PATENT DOCUMENTS

CA 2 112 565 8/2002
(Continued)

OTHER PUBLICATIONS

Office Action for U.S. Appl. No. 10/560,948, dated Dec. 24, 2008, 7 Pages.
(Continued)

*Primary Examiner* — Anthony Stashick
*Assistant Examiner* — James N Smalley
(74) *Attorney, Agent, or Firm* — Harness, Dickey & Pierce

(57) ABSTRACT

A capping system in combination with a container having a mouth and a wall segment disposed proximate to the mouth is provided. The capping system includes a cap having a bottom for selectively covering the mouth, a jacket extending from the bottom, and a guarantee ring disposed at a distal edge of the jacket. At least one cam extends from an outer surface of the wall segment, is at least partially overlapped by the guarantee ring, and applies a force on the guarantee ring when the cap is rotated a predetermined distance relative to the container to at least partially sever the guarantee ring. The guarantee ring includes an overlapping region extending over the cam that provides clearance for the cam when the cap is initially installed on the container to prevent deformation of the guarantee ring during the installation.

14 Claims, 10 Drawing Sheets

U.S. PATENT DOCUMENTS

| | | | | |
|---|---|---|---|---|
| 4,941,580 | A | 7/1990 | Julian | |
| 5,611,445 | A | 3/1997 | Kano et al. | |
| 7,712,619 | B2 * | 5/2010 | Schwarz et al. | 215/252 |
| 2003/0127420 | A1 | 7/2003 | Schumacher | |

FOREIGN PATENT DOCUMENTS

| | | | |
|---|---|---|---|
| CH | 560 139 | | 3/1975 |
| CL | 30074 | | 12/1977 |
| CL | 1237-98 | | 12/1999 |
| DE | 24 12 817 | A1 | 9/1975 |
| DE | 25 44 903 | C2 | 2/1987 |
| DE | 31 44 861 | C2 | 11/1989 |
| EP | 0 547 781 | A | 6/1993 |
| EP | 0 681 967 | A | 11/1995 |
| FR | 2 826 342 | A | 12/2002 |
| GB | 1 181 048 | | 2/1970 |
| GB | 1 453 208 | | 10/1976 |
| GB | 1 478 558 | | 7/1977 |
| IE | 40228 | | 4/1979 |
| JP | 53-40850 | | 4/1978 |
| JP | 58-52204 | | 11/1983 |
| JP | 1-28036 | | 8/1989 |
| WO | WO 3026980 | A1 * | 4/2003 |

OTHER PUBLICATIONS

Translation of Notice of Reasons for Rejection for Patent Application No. 2006-515780, mailed Jul. 22, 2008, 2 Pages.

International Search Report for CT/EP2004/005456, dated Oct. 20, 2004 (ISA/EP), 3 Pages.

Final Office Action for U.S. Appl. No. 10/560,948, dated Jan. 19, 2010.

Advisory Action for U.S. Appl. No. 10/560,948, dated Apr. 16, 2010.

Office Action for U.S. Appl. No. 10/560,948, dated Jul. 7, 2010.

International Search Report for PCT/EP2005/005456, ISA/EP, Rijswijk, NL, mailed Nov. 2, 2004.

Examiner's report No. 2 on Australian patent application No. 2004249370, mailed Sep. 22, 2010.

Examination Report for Chilean patent application No. 147204, dated Jun. 14, 2004.

Notification of First Office Action for Chinese patent application 200480016875.5, with English translation thereof.

Examination Report for New Zealand patent application No. 544214, dated Jul. 31, 2007.

* cited by examiner

SEALING SYSTEM AND METHOD FOR SEALING CONTAINERS

CROSS-REFERENCE TO RELATED APPLICATIONS

This application is a continuation of U.S. patent application Ser. No. 10/560,948 filed on Dec. 15, 2005. This application claims the benefit and priority of PCT International Application No. PCT/EP2004/005456 filed on May 21, 2004, which claims the benefit of DE 103 28 179.7 filed on Jun. 16, 2003. The entire disclosures of each of the above applications are incorporated herein by reference.

FIELD

The present disclosure relates to a capping system in combination with a container.

BACKGROUND

This section provides background information related to the present disclosure which is not necessarily prior art.

Capping systems for capping containers are known. They have a sealing cap overlapping the mouth of the container and are provided with a bottom and a jacket extending therefrom. On the edge of the jacket facing away from the bottom, there is provided a guarantee ring which is connected with said jacket by a predetermined rupture line and preferably has at least one vertical cut. The purpose of the guarantee ring is to indicate a first opening of the container and tampering with the sealing cap, to provide the user with the ability to check whether the closed container had been tampered with. Known capping systems have sealing caps that are connected with the container to be sealed by means of a thread, optionally by means of a bayonet lock, or sealing caps holding a stopper that is inserted into the mouth of the container. The guarantee ring is ruptured by the fact that, during the first opening of the container, the sealing cap is displaced in the direction of its rotational axis and that there are provided appropriate barbs or the like that rupture the guarantee ring when the sealing cap is unscrewed. Cap-ping systems of this kind are therefore relatively complicated and, hence, expensive to fabricate.

SUMMARY

This section provides a general summary of the disclosure, and is not a comprehensive disclosure of its full scope or all of its features.

The object of the invention therefore is to provide a capping system that can be fabricated in simple and inexpensive manner without jeopardizing the safety function of the guarantee ring.

To reach this objective, it is proposed to use a sealing cap including a bottom, a jacket extending therefrom and a guarantee ring which is preferably provided with at least one vertical cut, namely with a material-weakening line that extends essentially transversely to the circumferential direction thereof, and is configured so that said guarantee ring can rupture along said line. Moreover, the capping system also has a wall segment surrounding the mouth of the container, which at least in some regions is overlapped by the jacket of the sealing cap and is characterized by the fact that there is provided a cam that extends beyond the outer peripheral surface of the wall segment. Said cam is disposed in the region of the guarantee ring and is laterally surrounded thereby. By this is meant that, as seen in the circumferential direction, the lateral limit surfaces of the cam can engage with the guarantee ring when the sealing cap is twisted. In other words, positive locking is achieved.

When the sealing cap is twisted, the cam forces the guarantee ring so far outward that the ring ruptures. The rupturing of the guarantee ring is facilitated by the at least one weakening line, here referred to as the vertical cut. As a result of the rupturing of the guarantee ring, the sealing cap can readily be removed from the mouth of the container, namely from the here indicated wall segment, by bringing about a relative movement between the sealing cap and the wall segment. The purpose of the cam is therefore to widen and preferably rupture the guarantee ring when the sealing cap is twisted. In this respect, it is not necessary that a thread be provided between the sealing cap and the wall segment that surrounds the mouth of the container, which substantially simplifies and thus reduces the cost of fabricating the capping system.

Otherwise, the capping system is particularly user-friendly because it makes it possible to rupture the guarantee ring by twisting the sealing cap in either direction, namely in the clockwise and counter-clockwise direction.

In a particularly preferred embodiment of the capping system, the container is closed off by means of a stopper, and the sealing cap is slipped over said stopper and thus placed on the mouth of the container. In this case, the bottom of the sealing cap covers the mouth of the container, but the stopper closing off the container is disposed between said bottom and the mouth.

Other embodiments are covered by the subclaims.

A method may include placing a sealing cap on the mouth of a container, for example pressed on by means of a plunger. The lower free edge of the sealing cap, namely the edge of the guarantee ring, is flanged, namely deformed in the direction of the wall region surrounding the mouth of the container. Of course, no such deformation is carried out in the region of the cam so that the guarantee ring laterally surrounds the cam. As a result, it is ensured that when the sealing cap is twisted, the cam will widen and preferably rupture the guarantee ring.

In another preferred embodiment of the method, first the stopper is placed on the container and then the sealing cap is put over it. This completes the first step of the above-said method, namely placing the sealing cap on the mouth of the container. The other steps then follow, as indicated hereinabove.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
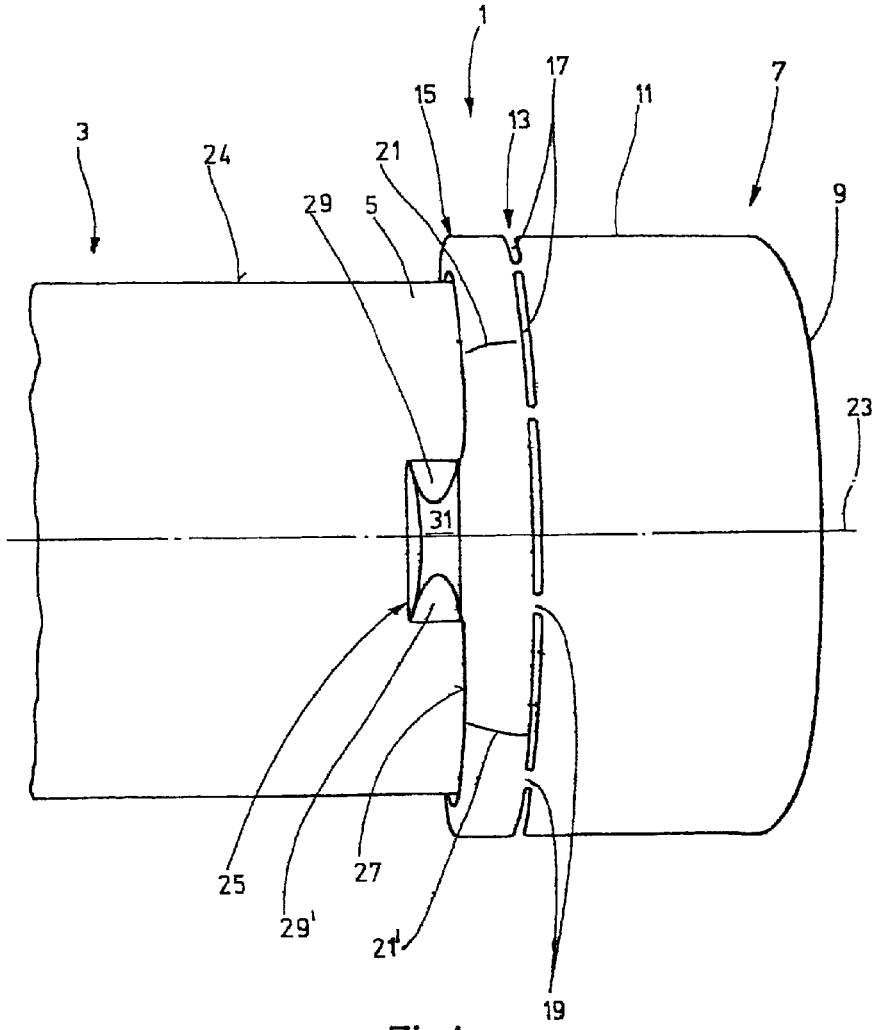
FIG. 1 shows a side view of a capping system in the closed condition.

FIG. 1 shows a capping system 1 for a container 3 which is provided with a mouth and of which here is represented a wall region that surrounds the mouth and that at least in some regions is overlapped by a sealing cap 7.

Sealing cap 7 has a bottom 9 covering the mouth of the container to which is attached, here toward the left, a jacket 11. A guarantee ring 15 is connected to said jacket via a predetermined rupture line 13.

Here, in the circumferential direction, predetermined rupture line 13 is provided with slits 17 with their ends bordering on connecting pieces 19 extending between guarantee ring 15 and jacket 11, said slits being so narrow that they securely hold guarantee ring 15 on jacket 11, but allow a swiveling motion of parts of guarantee ring 15 which will be discussed in detail hereinbelow. Predetermined rupture line 13 can also be created by material weakening, namely by a linear region of reduced wall thickness.

Guarantee ring 15 is provided with at least one, and in the embodiment represented here with several, vertical cuts 21, 21' disposed transversely to the circumferential direction of guarantee ring 15, namely approximately parallel to the center axis 23 of the part of container 3 represented here and of sealing cap 7. Vertical cuts 21, 21' serve to weaken the material of the guarantee ring and make it possible for said ring to be ruptured in the region of vertical cuts 21, 21'. The vertical cuts can also be created by material weakening, namely by a region of reduced wall thickness, but also by a cut in the material of guarantee ring 15. The expression "vertical cuts" thus serves only to refer to tearing regions in guarantee ring 15 and not to stipulate the creation of these regions.

Here, on peripheral surface 24 of wall segment 5 there is provided a cam 25 which is disposed in the direction facing the observer of FIG. 1 and in the region of edge 27 facing away from bottom 9 of sealing cap 7. On its lateral edges disposed in the circumferential direction, said cam is provided with start-up slopes 29, 29'. In other words, at an acute angle the lateral edges gradually change into circumferential surface 24 of wall segment 5.

Cam 25 is preferably an integral part of wall region 5. It is also conceivable, however, to place a separate cam onto wall segment 5 or insert a separate cam into said wall, with the cam protruding over circumferential surface 24, as shown here.

Seen transversely across wall segment 5, cam 25 has a width such that said cam is in any case disposed in the region of edge 27 even if the height of jacket 11 measured in the direction of the center line 23 varies for fabrication-related reasons.

It is also possible, however, to make cam 25 intentionally so wide that different sealing caps 7 can be placed on container 3, namely sealing caps that more or less overlap wall segment 5.

In the embodiment represented here, cam 25 on one side extends somewhat beyond edge 27 under guarantee ring 15 and on the other side clearly protrudes beyond edge 27.

In the region of edge 27, guarantee ring 15 is flanged which can readily be recognized above and below in the transition range between sealing cap 7 and container 3. In other words, jacket 11 of sealing cap 7 is bent and preferably flanged in the region of guarantee ring 15 in the direction toward circumferential surface 24. FIG. 1 also shows clearly that on the top side 31 of cam 25 facing the observer, edge 27 of guarantee ring 15 is not flanged. In other words, the wall of guarantee ring 15 is essentially shaped around the outer contour of cam 25 so that edge 27 rests on the start-up slopes 29, 29' of cam 25, said cam, as seen in the circumferential direction, being laterally surrounded by the guarantee ring.

At any rate, for the function of capping system 1, it is only necessary that guarantee ring 15 have a region capable of accommodating cam 25 without an excessive expansion of the guarantee ring and that cam 25 be laterally surrounded by the wall of guarantee ring 15 so that a positive lock is achieved. In this regard, it is not absolutely necessary that edge 27 of guarantee ring 15 rest directly on start-up slopes 29, 29' of cam 25. Conceivably, there can be a distance between guarantee ring 15 and start-up slopes 29, 29'. It is crucial that cam 25 be able to extent partly under guarantee ring 15 without causing damage to said ring. In neighboring regions, however, edge 27 of guarantee ring 15 approaches circumferential surface 24 of wall segment 5 so that sealing cap 7 cannot be readily twisted.

FIG. 1 shows capping system 1 in the closed condition, namely with the guarantee ring 15 intact.

Figure 2:
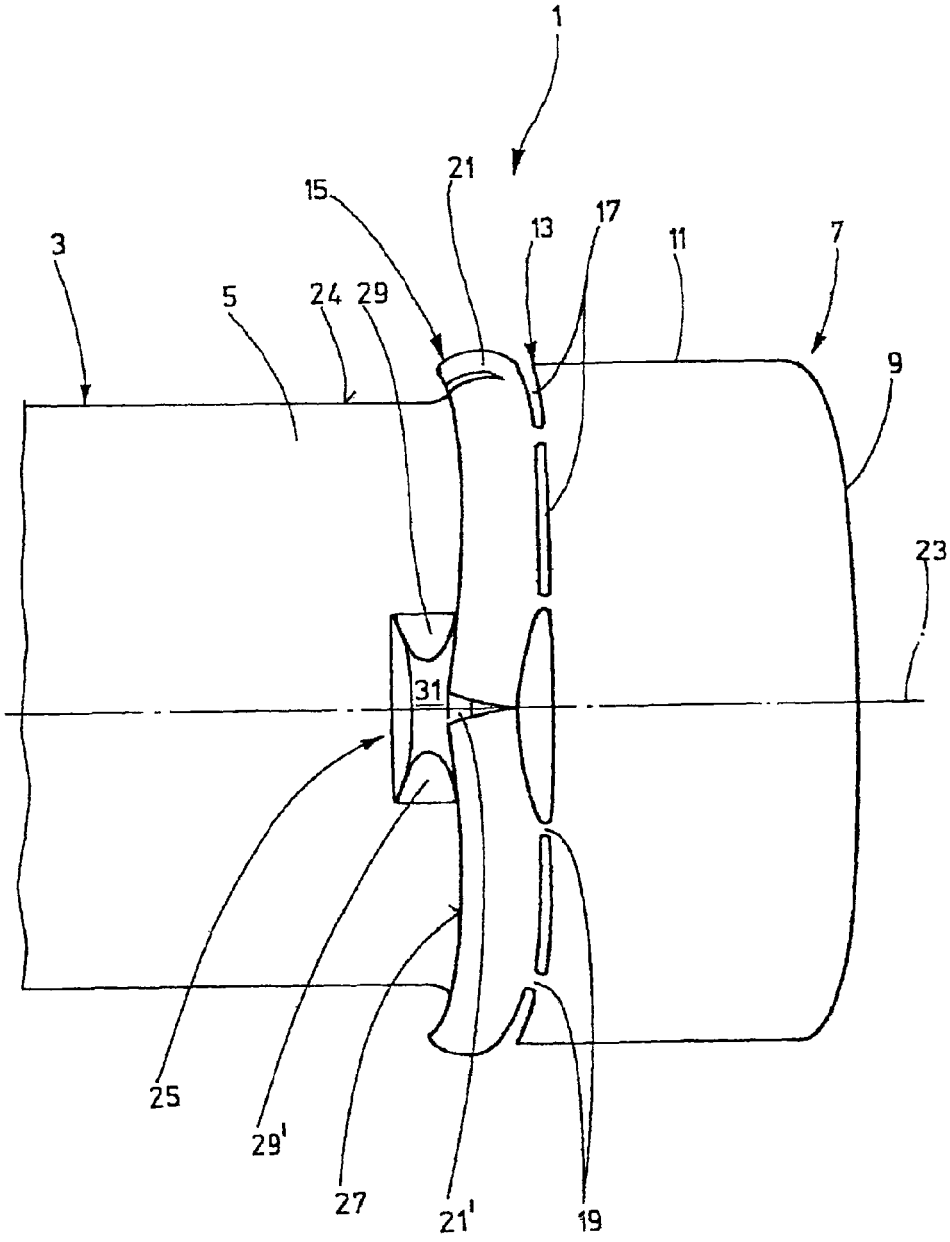
FIG. 2 shows an exploded side view of the capping system.

FIG. 2 shows capping system 1 of FIG. 1 in the opened condition. Identical parts are identified by the same reference numerals so that the reader may refer to the description for FIG. 1.

FIG. 2 shows clearly that guarantee ring 15 is ruptured, namely that at least one vertical cut 21, 21' is torn and that two ring segments of guarantee ring 15 located between neighboring vertical cuts are turned outward, as seen from the circumferential surface 24 of wall segment 5. FIG. 2 shows clearly that slits 17 have changed their contour. In particular, the slit located in the region of a torn vertical cut is clearly widened. The ring segments of a guarantee ring 15 located between two vertical cuts are held by connecting pieces 19 also in the expanded and outward bent condition so that guarantee ring 15 is held on jacket 11 of sealing cap 7 and is removed from container 3 together with said jacket. The expanded ring elements clearly indicate tampering and a first opening more clearly than does just an expanded guarantee ring.

The rupturing of guarantee ring 15 occurs in the following manner: Sealing cap 7 and container 3 are twisted relative to one another so that start-up slopes 29, 29' press outward edge 27 of guarantee ring 15 that is bent toward circumferential surface 24. This causes expansion and preferably rupture of the guarantee ring which is facilitated by the at least one vertical cut 21.

When sealing cap 7 is made of a deformable material, preferably sheet aluminum, edge 27 that is bent toward the circumferential surface ensures that in guarantee ring 15 start-up slopes 29, 29' generate forces directed outward, namely away from circumferential surface 24, which forces ultimately rupture guarantee ring 15. If sealing cap 7 is made of some other material, then it is only necessary to provide a thinner wall segment in the region of cam 25 to prevent cam 25 from rupturing guarantee ring 15 when the cap is placed on the container. The region of lower wall thickness is followed—as seen in the circumferential direction—by a segment of the guarantee ring with a thicker wall. When sealing cap 7 is twisted, said regions of greater thickness extend up to start-up slopes 29, 29'. In this manner, in such an embodiment of sealing cap 7 made, for example of a plastic material, too, guarantee ring 15 is ruptured with the aid of cam 25.

FIG. 2 also shows that cam 25 extends to the right beyond edge 27 and under guarantee ring 15. Here, too, it is thus clearly shown that cam 25 is disposed in the region of edge 27 of guarantee ring 15 and that the edge can extend to the right and to the left to be able to comply with fabrication tolerances in the production of sealing cap 7.

Figure 3:
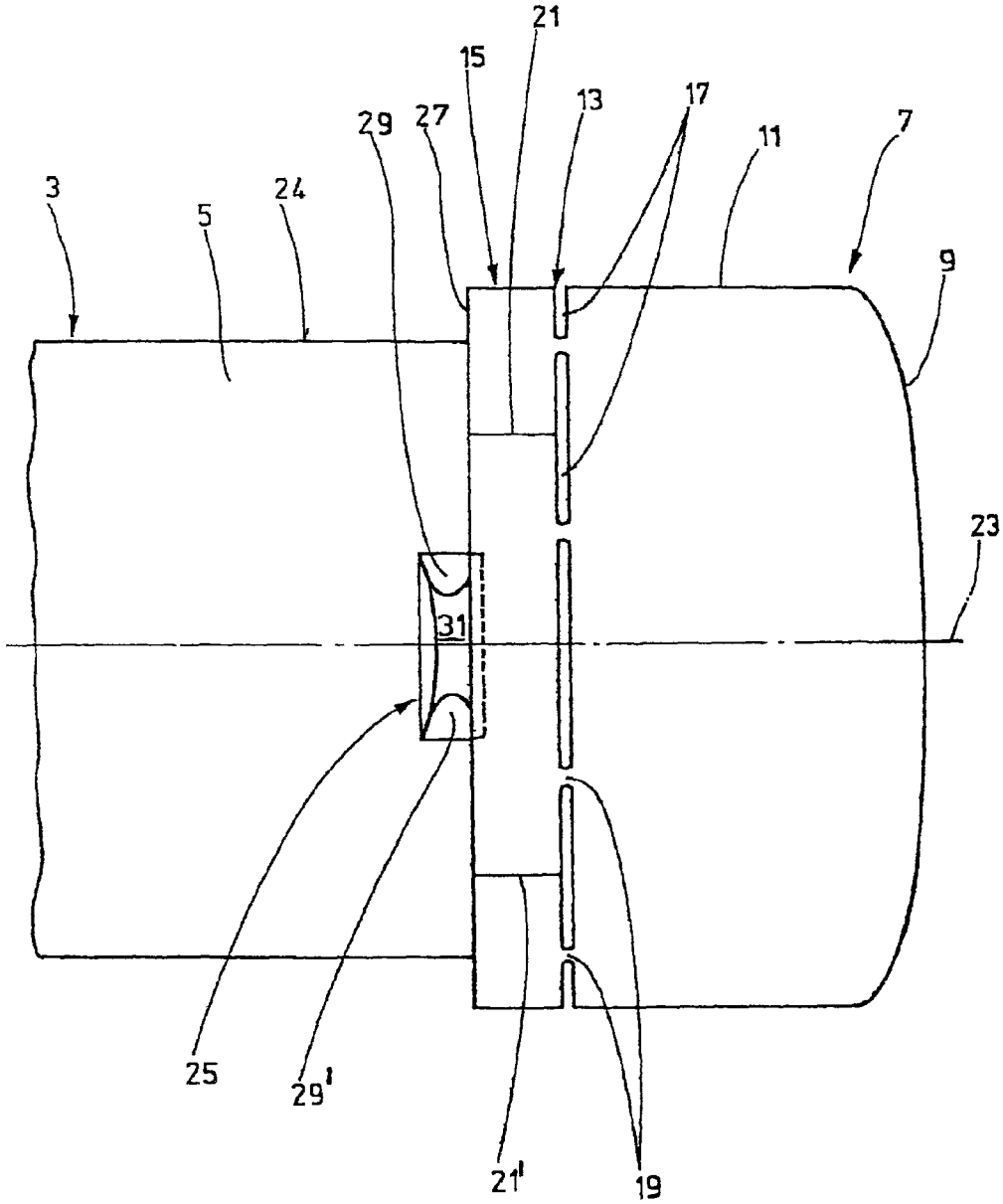
FIG. 3 shows a side view of a capping system before the guarantee ring is formed.

FIG. 3 shows capping system 1 just before sealing cap 7 is placed on container 3. Identical parts are identified by the same reference numerals so that, to avoid repetition, the reader is referred to the description of the foregoing figures.

The representation in FIG. 3 shows clearly that edge 27 still lies on the same circumferential line as the remainder of guarantee ring 15. In other words, sealing cap 7 is only placed on container 3 without a region of guarantee ring 15 being bent toward circumferential surface 24 and deformed. In other words, sealing cap 7 is still freely turnable, because the lateral limit edges of cam 25—as seen in the circumferential direction—namely start-up slopes 29, 29', are not yet surrounded.

Figure 4:
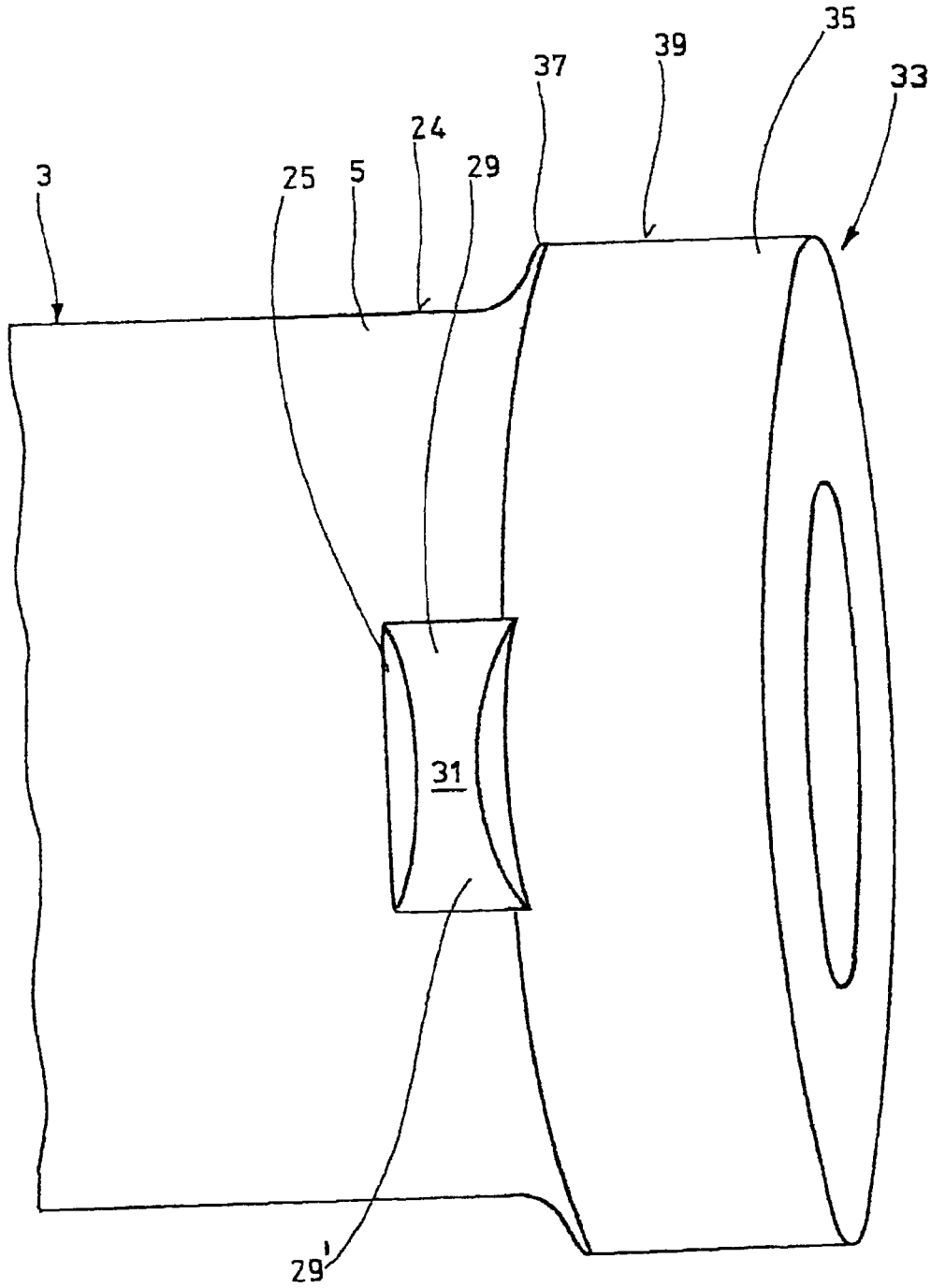
FIG. 4 shows a side view of an open container.

FIG. 4 shows in perspective a container 3 with the sealing cap removed. Identical parts are identified by the same reference numerals so that, to avoid repetition, the reader is referred to the description of the foregoing figures.

FIG. 4 shows wall segment 5 from the circumferential surface 24 of which cam 25 rises. Wall segment 5 surrounds mouth 33 of container 3 which is preferably provided with an annular bead 35 extending all around mouth 33. Cam 25 is disposed on the side of annular bead 35 facing mouth 33. It is clear that with sealing cap 7 placed on the container, lower edge 27 can be bent or flanged in the region of edge 37 facing away from mouth 33 thus being able to rest closer to circumferential surface 24 than does outer ring surface 39 of annular bead 35. In other words, the diameter of circumferential surface 24 is smaller than that of annular surface 39. Annular bead 35 thus provides a fastening rim for flanged edge 27 of guarantee ring 15 so that sealing cap 7 can be securely anchored on container 3. It is clear that container 3 has no outer threads in the region of annular bead 35. Hence, it is not necessary to provide the inner surface of sealing cap 7 with a corresponding inner thread. It is also possible to place sealing cap 7 on container 3 and by means of frictional locking, but preferably by positive locking, to anchor said cap securely on said container, namely by bending edge 27 of guarantee ring 15 around rim 37 of annular bead facing away from mouth 33.

It is clear from the explanations that the purpose of annular bead 35 is to anchor sealing cap 7 on container 3. Naturally, this anchoring can also be achieved by providing in place of annular bead 35 only a few bead segments distributed over the circumferential surface of container 3 and each having an edge 37 facing away from mouth 33 under which edge lower edge 27 of sealing cap 7 can engage. Preferably, however, a continuous annular bead 35 is chosen for the anchoring of sealing cap 7, because such a bead can have a closed circumferential surface, namely an annular surface 39, so that sealing cap 7 can easily be twisted on container 3 when said container is to be opened.

Because cam 25 is directly adjacent to annular bead 35, here the transition between annular surface 39 and circumferential surface 24 is omitted so that here edge 27 of the guarantee ring cannot be bent. Rather, edge 27 extends from top side 31 along start-up slopes 29, 29' toward circumferential surface 24, as explained in detail hereinabove.

In principle, it is possible to create a capping system 1 wherein sealing cap 7 is placed directly on container 3 so that bottom 9 of sealing cap 7 closes off mouth 33. Preferably, an appropriate gasket is then provided on the inner side of bottom 9 facing mouth 33.

Figure 5:
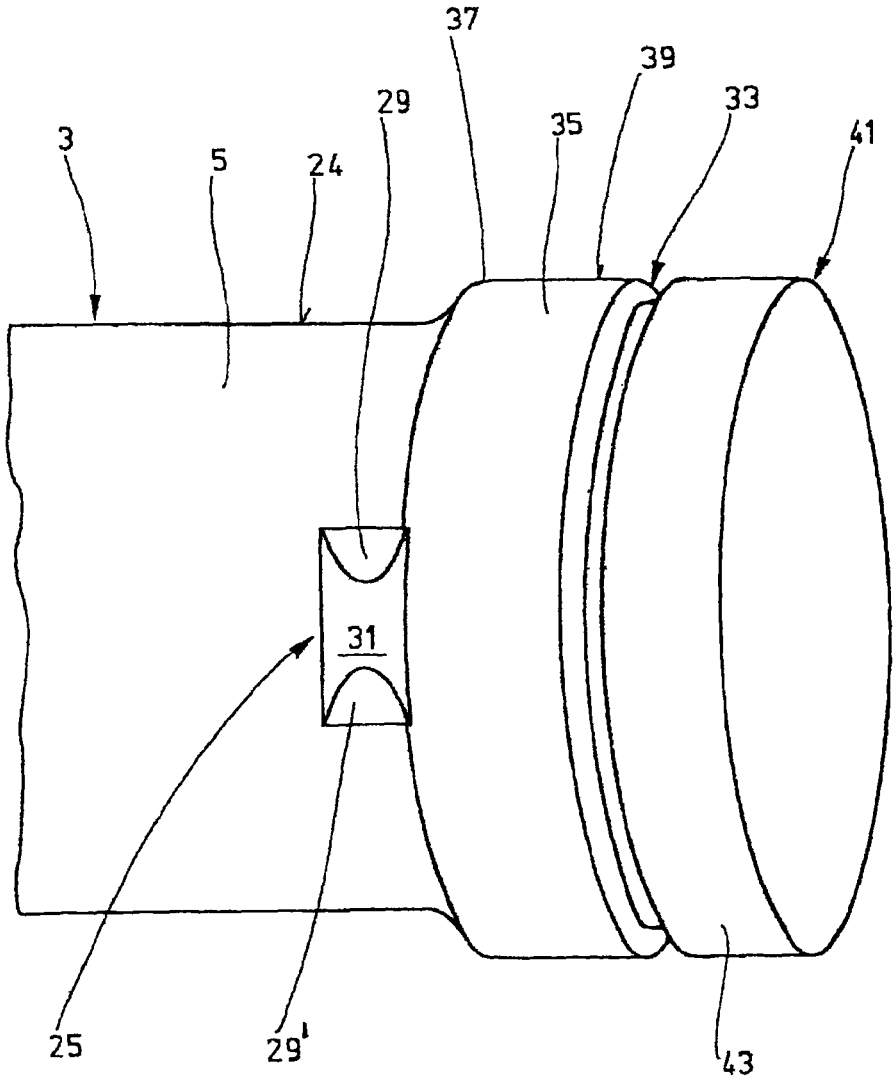
FIG. 5 shows a side view of a container closed off with a stopper.

FIG. 5, on the other hand, shows a perspective view of container 3 with the sealing cap removed. Identical parts are identified by the same reference numerals so that the reader is referred to the description of the foregoing figures, particularly to the description of FIG. 4.

The only difference compared to the representation in FIG. 4 consists in that container 3 is closed off with a stopper 41 the extension of which, not seen here, extends into the container so that head 43 of the stopper covers the mouth.

Container 3 can be closed off directly by stopper 41 itself or by a gasket provided between the stopper and the container so that liquid contents of the container cannot leak out. Stopper 41 can be made of glass, stoneware, plastic material or the like.

Thus, capping system 1 can also comprise a stopper 41 that is securely held by the sealing cap.

Capping system 1 described here is preferably used in conjunction with containers closed off by stoppers of the kind addressed here. Sealing cap 7 securely protects such a system against tampering as well as against unintentional opening. The container can be opened in simple fashion by twisting sealing cap 7 so that guarantee ring 15 is ruptured by the action of cam 25 which makes it possible to remove sealing cap 7 in simple manner. Container 3 can once again be closed off in simple fashion by means of stopper 41 even when sealing cap 7 has been removed.

FIG. 6 shows once again a side view of the anterior region of a container 3. Here, too, identical parts are identified by the same reference numerals so that the reader is referred to the foregoing description.

Figure 6:
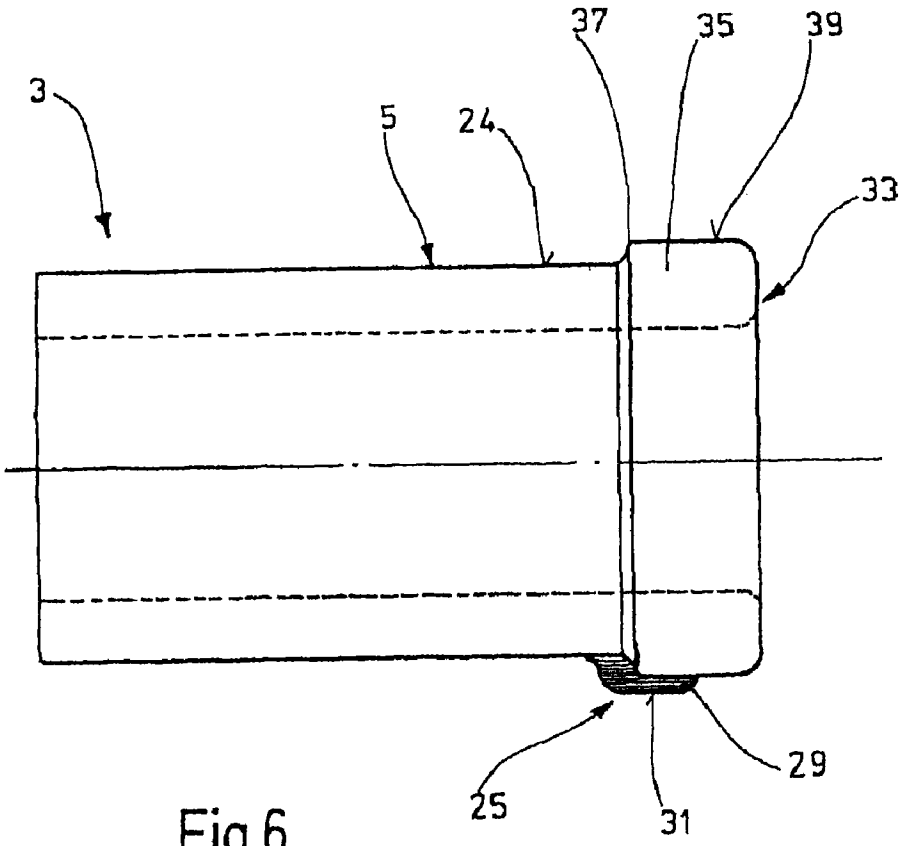
FIG. 6 shows a side view of the mouth region of a container without a sealing cap.

FIG. 6 shows a slightly modified embodiment of a container 3 with a cam 25 rising from wall region 5.

Here, it can clearly be seen that cam 25 extends all the way into annular bead 35 and—measured from circumferential surface 24—is higher than said bead. It should be particularly stressed that, as shown hereinabove, a cam that is directly adjacent to an annular bead 35 is sufficient for a capping system of the kind addressed here. It is also not necessary that the height of the cam be greater than the height of annular bead 35 that extends beyond circumferential surface 24.

Figure 7:
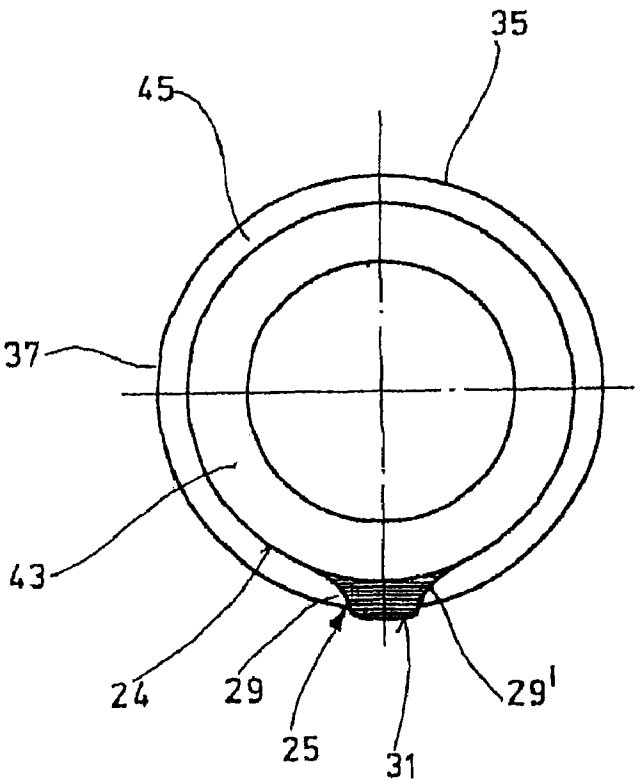
FIG. 7 shows an underside view of the mouth region shown in FIG. 6.

FIG. 7 shows the underside of annular bead 35 or the underside of edge 37 thereof.

FIG. 7 shows, from the left, a view of the segment of container 3 represented in FIG. 6. Clearly re-cognizable is wall 43 of container 3 which in FIG. 6 is indicated by a broken line. Cam 25 rises from circumferential surface 24, said cam not dropping off vertically toward circumferential surface 24, but being provided with inclined side surfaces forming start-up slopes 29 and 29', as indicated hereinabove.

The width of the base of cam 25 measured in circumferential direction and the width in the region of top side 31 can be chosen at will. It is crucial that a guarantee ring placed on container 3 have a region in which, when the container is being closed off, cam 25 comes to rest without rupturing the guarantee ring. When container 3 and sealing cap 7 are twisted relative to one another, start-up slopes 29, 29' widen the guarantee ring to the extent that said ring is ruptured. The guarantee ring is preferably provided with at least one vertical cut 21, 21', as explained in the foregoing. The purpose of the vertical cut is to facilitate the rupturing of guarantee ring 15, to provide defined incision regions within the guarantee ring and, moreover, to make it easier to recognize tampering and a first opening.

The number of cams is preferably chosen in accordance with the number of vertical cuts. Preferably, the number of cams is greater or less than that of the vertical cuts. When the number of cams is greater than one, the twisting motion required to fully rupture guarantee ring 15 when sealing cap 7 is twisted relative to container 3 is shorter. If, as in the embodiment shown in FIG. 7, only one cam 25 is provided, then sealing cap 7 must be twisted by approximately 360° to widen and preferably rupture guarantee ring 15 along its entire circumferential surface so that the sealing cap can be removed from the container. If, for example, three cams are provided, a twist of about 120° is sufficient.

In view of all this, it is quite possible to combine a capping system of the kind addressed here with a sealing cap made of a plastic material and thus to prevent the cam from rupturing the guarantee ring the first time a container is closed off. When the sealing cap is twisted relative to the container, the twisting direction being unimportant, the cam will widen the guarantee ring to an extent such that said ring will rupture. Even with sealing caps made of plastic material, there is provided at least one vertical cut to prevent the twisting forces from becoming excessive when the sealing cap is twisted.

The capping system described here can have sealing caps 7 that can be placed directly onto a container 3, said caps in the bottom region then being provided with a gasket facing the mouth of the container. Preferably, however, capping system 1 contains a stopper 41 which closes a container 3 so that it is liquid leakage-proof. In this case, sealing cap 7 requires no gasket, because tight sealing of container 3 by stopper 41, optionally in conjunction with a gasket, is achieved. In such a capping system, stopper 41 is secured by the sealing cap.

Particularly preferred is a capping system of the kind described here wherein sealing cap 7 is made of aluminum. This is because this material does not exert a deleterious effect on the contents of container 3, and in the region of edge 27 of guarantee ring 15 it can be flanged very simply, particularly with current flanging devices. Capping systems 1 in which container 3 is provided with an annular bead 35 have proved to be particularly advantageous. Said bead supports sealing cap 7 during the flanging and by its edge 37 provides a defined region in which guarantee ring 15 is flanged. Moreover, sealing cap 7 finds an unusually good hold on edge 37.

Cam 25, explained here in detail, is required to rupture guarantee ring 15. Said cam can be directly adjacent to annular bead 35 or it can extend into it. In this regard, it is preferred that the height of the cam be greater than that of the annular bead. The explanations make it clear, however, that cam 25 may also be equally as high as or lower than annular bead 35. It is crucial that in the event of a twisting motion between sealing cap 7 and container 3 the guarantee ring be widened and preferably ruptured so that tampering with the capping system and a first opening can readily be recognized by the user.

Moreover, after the widening or rupturing of the guarantee ring, the sealing cap can be removed in axial direction, namely in the direction of center axis 23, so that container 3 is open or at least that stopper 41 is freely accessible.

It is also clear that the number of cams 25 can be chosen at will. Sealing cap 7 must be twisted until cam 25 has widened all regions of the guarantee ring and possibly has ruptured it.

It can be seen from the explanations that the configuration of guarantee ring 15 can be chosen at will within wide limits. On the one hand, it is possible to omit the surrounding predetermined rupture line and, on the other, even the at least one vertical cut 21 can be omitted. In this regard, it should be kept in mind that the forces needed to widen the lower edge of guarantee ring 15 can be clearly reduced by providing the at least one vertical cut. This effect can also be brought about, however, by choosing a thinner or softer material to fabricate sealing cap 7.

A similar situation applies to predetermined rupture line 13. The lower edge 27 of guarantee ring 15 is widened by the action of cam 25. The predetermined rupture line enables the lower edge of jacket 11 to swing outward particularly when by several vertical cuts have created quasi-ring segments which in the region of predetermined rupture line 13 swing out radially. As a result of this swinging movement, the opening forces needed to twist sealing cap 7 are reduced. Here, too, it is possible to reduce the opening forces, namely the forces required to twist sealing cap 7, by use of a softer material or a jacket 11 with a thinner wall.

Crucial for the function of capping system 1 is the fact that sealing cap 7, seen in axial direction, is kept on container 3 until edge 27 has been widened by cam 25 as a result of a twisting motion of sealing cap 7 so that sealing cap 7 can be lifted in axial direction.

From all this, it is clear that sealing cap 7 can be opened by a simple twisting motion. In other words, it is not necessary to provide container 3 with an outer thread which in the event of a twisting motion would bring about a simultaneous axial movement thereof. In other words, lower edge 27 of sealing cap 7 is bent by just a twisting motion without the need for a concomitant axial motion of sealing cap 7.

The shape of the cam is variable. As shown here, said cam can have a rectangular, square or elliptical base. Decisive are the start-up slopes which should not prevent the turning of the sealing cap and must ensure that the guarantee ring can be widened or preferably ruptured.

Figure 8:
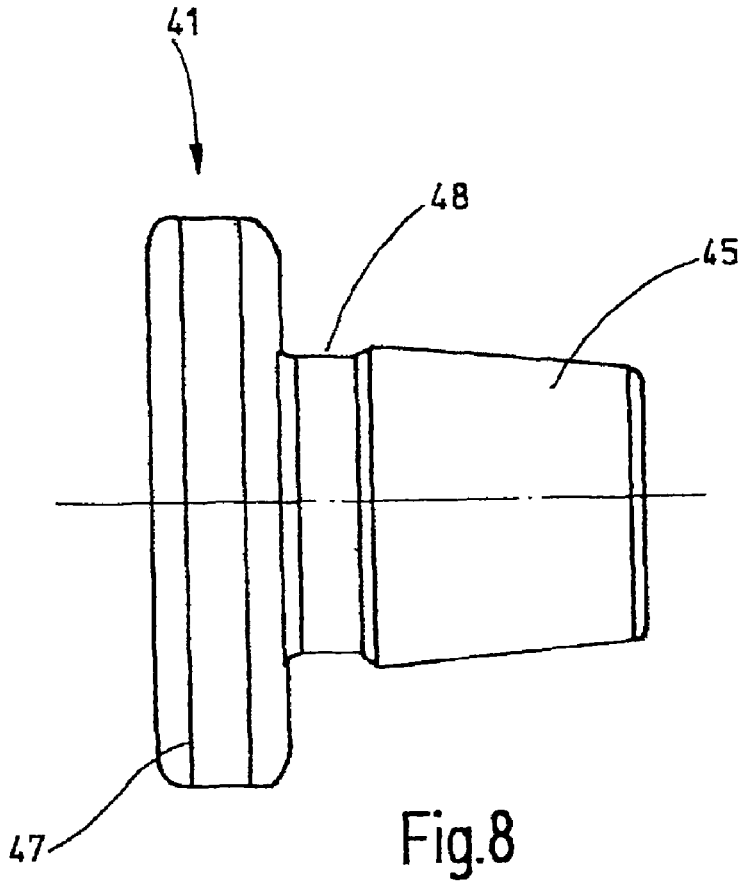
FIG. 8 shows a side view of a stopper.
Figure 9:
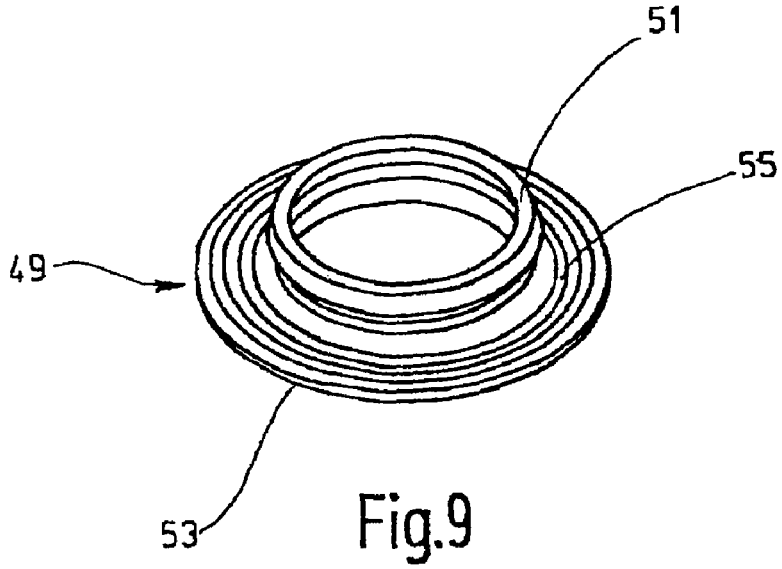
FIG. 9 shows a view in perspective of a gasket that can be used in association with the stopper of FIG. 8.
Figure 10:
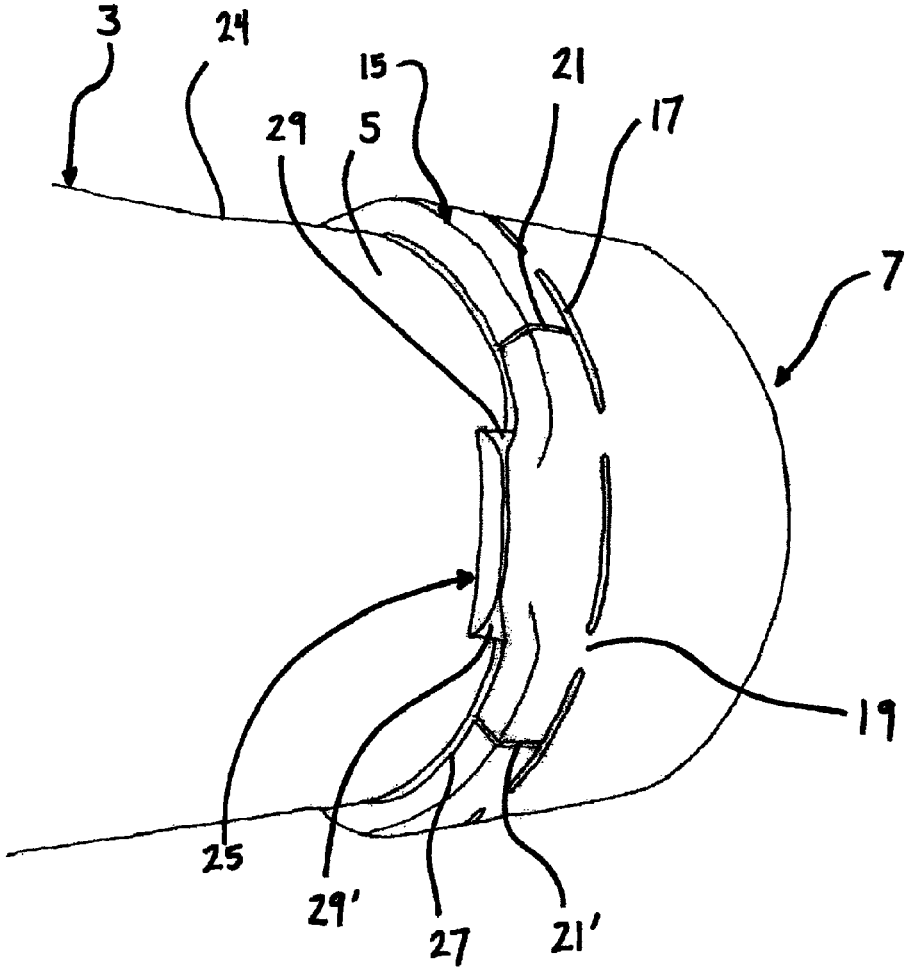
Figure 11:
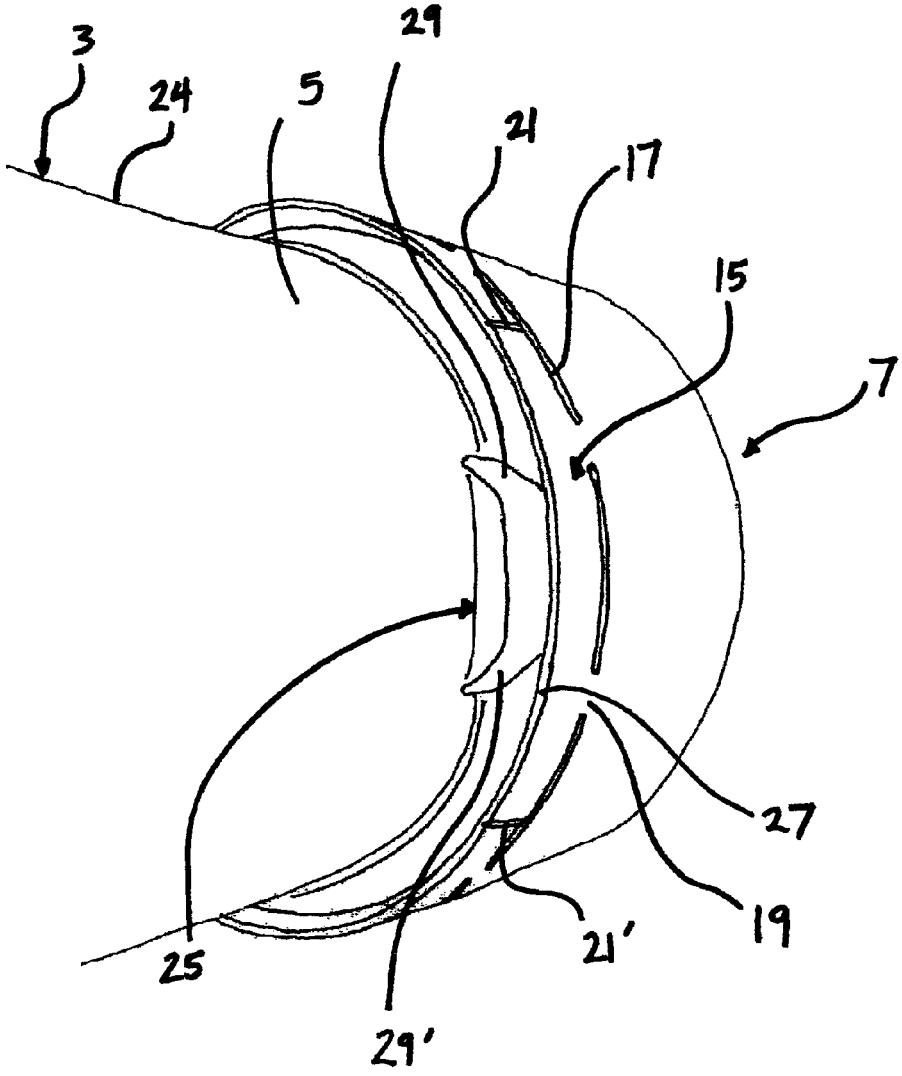
Figure 12:
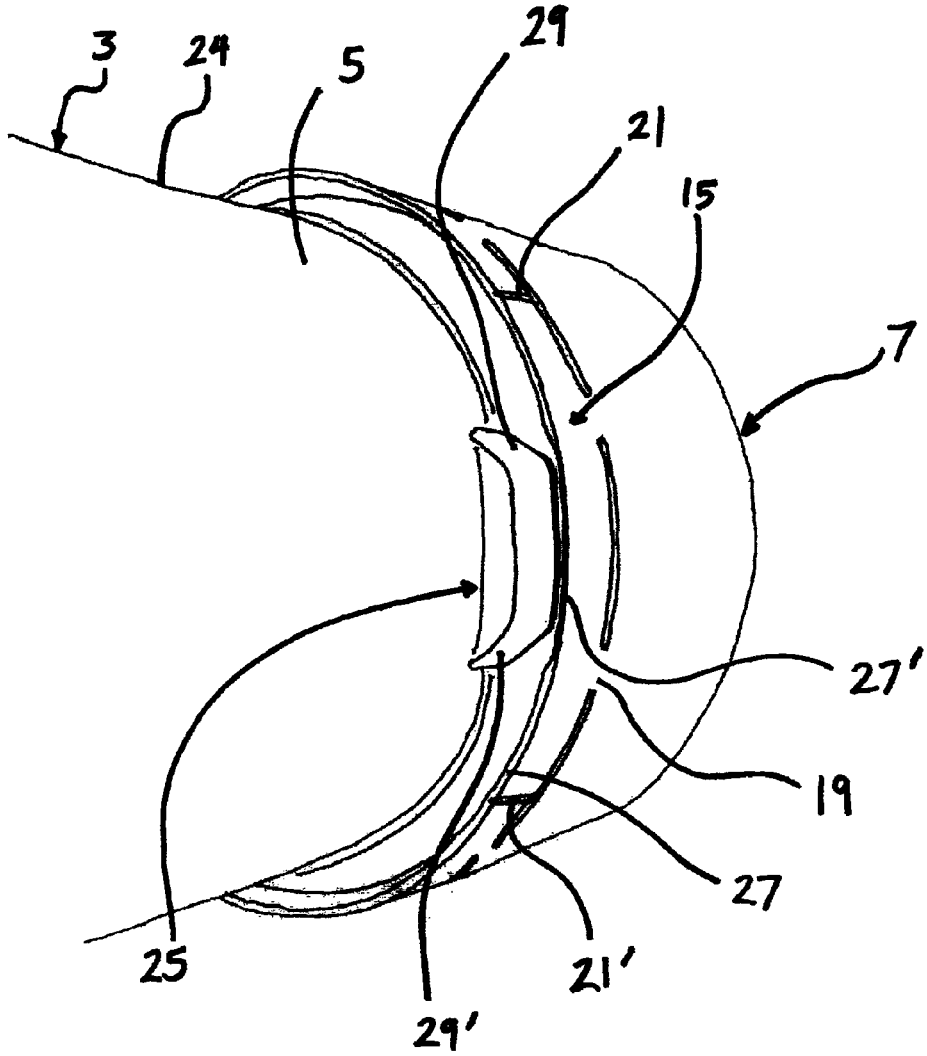

FIG. 8 shows a stopper 41 which preferably is part of a capping system of the kind addressed here and which with its extension 45 can be inserted into the mouth of a container. In the transition region between extension 45 and head 47 of stopper 41 there is provided a surrounding annular groove 48 into which a gasket can be inserted. A possible configuration of gasket 49 is shown in FIG. 9. It has a cylindrical attachment 51 that can be inserted into annular groove 48. To the attachment is connected an annular sealing segment 53 with a number of all-around-extending ribs 55 which, when stopper 41 is put into position, cooperate with the mouth of a container closing it off in sealing manner. In other words, gasket 49 can close off a container 3 in sealing manner on the one hand with stopper 41 and/or, on the other, with the aid of ribs 55.

A method for a sealing container provided with a mouth will be described in greater detail in the following. Particularly preferred is a method using capping system 1 described herein.

According to this method, first sealing cap 7 is placed on the mouth of a container 3. In a subsequent step, the sealing cap is pressed onto the mouth of the container with a plunger. The guarantee ring is then flanged, namely bent in the direction of circumferential surface 24 of wall segment 5 of a container 3. Wall segment 5 is provided with a cam 25 which is disposed in the region of guarantee ring 15 in a manner such that here during the flanging edge 27 of guarantee ring 15 cannot be deformed, namely it cannot be bent. In the region of top side 31 of cam 25, edge 27 of the sealing cap remains practically unchanged. In the regions adjacent to top side 31 that form start-up slopes 29 and 29', edge 27 is adapted to the outer surface of cam 25 so as to embrace said cam laterally thus creating a positive lock.

The method is preferably modified by first placing stopper 41 on the container. Only then are the above-indicated steps carried out, namely: placing the sealing cap on the mouth of the container which now is closed off by the stopper; pressing the sealing cap on; flanging the edge of the guarantee ring without deforming said edge in the region of the cam so that the flanged regions of the guarantee ring laterally overlap the cam.

When the capping system is fabricated without a stopper, the transition region between the bottom and the jacket of the sealing cap is preferably subjected to a deep-drawing process so that the gasket pro-vided in this case is pressed onto the container.

All this indicates that the method is variable: It is clear from the explanations concerning the capping system and the method of capping a container that the capping system described herein is simple to create. Moreover, it can be seen that the capping system can be opened without any auxiliary means: sealing cap 7 is loosened by twisting it relative to capped container 3, namely the cam widens the guarantee ring rupturing it, preferably at a predetermined rupture line. In this manner, the sealing cap can be removed from the container so that said container can be opened, possibly after removing a stopper disposed under the sealing cap, thus making its contents accessible. Capsule lifters, cork-screws and the like are by no means needed to open a container equipped with a capping system of the kind addressed here. By the configuration of the start-up slopes of the cam and by the height of the cam, and moreover by the configuration of the guarantee ring of the sealing cap, the forces needed to twist said sealing cap can be adjusted within wide limits. In principle, it is possible to provide the sealing cap with a smooth outer surface so as to render it visually very attractive. It is also conceivable to pro-vide knurling or the like.

The height of the sealing cap, namely the distance from the bottom of the sealing cap to its guarantee ring, can be varied within wide limits, because there is no need to provide any threads or the like on the outside of the container to be capped, particularly on the outside of the wall segment around the mouth. Hence, it is possible to create very flat sealing caps that also extend over a wide region of the wall segment, namely are high so as to provide the container with an esthetic element. Thus, the positioning of the cam will vary depending on the configuration of the sealing cap to ensure that said cam is always disposed in the region of the guarantee ring and is able to rupture it.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A capping system in combination with a container having a mouth and a wall segment disposed proximate to the mouth, the capping system comprising:

a cap including a bottom for selectively covering the mouth, a jacket extending from said bottom, and a guarantee ring disposed at a distal edge of said jacket, said guarantee ring connected to said jacket via a predetermined rupture line; and at least one cam extending from an outer surface of the wall segment, at least partially overlapped by said guarantee ring, and applying a force on said guarantee ring when said cap is rotated a predetermined distance relative to the container to at least partially sever said guarantee ring in a direction substantially perpendicular to said predetermined rupture line, said guarantee ring including an overlapping region extending over said cam;

wherein said guarantee ring includes an edge bent toward the outer surface of the wall segment, said bent edge being disposed adjacent to at least one of a first end and a second end of said overlapping region and engaging said cam when said cap is rotated relative to the wall segment;

wherein said bent edge extends around a perimeter of said guarantee ring between said first end of said overlapping region and said second end of said overlapping region; and wherein said guarantee ring includes a first wall thickness and a second wall thickness less than said first wall thickness, said first wall thickness extending around a perimeter of said guarantee ring between a first end of said overlapping region and a second end of said overlapping region, said second wall thickness extending across said overlapping region between said first end and said second end.

2. A capping system in combination with a container having a mouth and a wall segment disposed proximate to the mouth, the capping system comprising:

a cap including a bottom for selectively covering the mouth, a jacket extending from said bottom, and a guarantee ring disposed at a distal edge of said jacket, said guarantee ring connected to said jacket via a predetermined rupture line; and at least one cam extending from an outer surface of the wall segment, at least partially overlapped by said guarantee ring, and applying a force on said guarantee ring when said cap is rotated a predetermined distance relative to the container to at least partially sever said guarantee ring in a direction substantially perpendicular to said predetermined rupture line, said guarantee ring including an overlapping region extending over said cam;

wherein said guarantee ring includes an edge bent toward the outer surface of the wall segment, said bent edge being disposed adjacent to at least one of a first end and a second end of said overlapping region and engaging said cam when said cap is rotated relative to the wall segment;

wherein said cam includes at least one sloped surface, said at least one sloped surface engaging said bent edge of said guarantee ring to apply a force on said guarantee ring when said cap is rotated relative to the wall segment; and wherein said cam includes a pair of sloped surfaces disposed at opposite ends of said cam, said sloped surfaces engaging said bent edge of said guarantee ring to apply a force on said guarantee ring when said cap is rotated relative to the wall segment in either a first direction or a second direction.

3. The capping system of claim 1, wherein said cam engages said first wall thickness of said guarantee ring to apply a force on said guarantee ring when said cap is rotated relative to the wall segment in either a first direction or a second direction.

4. The capping system of claim 1, wherein said cam is in contact with a surface of said guarantee ring in said overlapping region when said cap is initially installed on the container.

5. The capping system of claim 1, wherein said cam is spaced apart from a surface of said guarantee ring in said overlapping region when said cap is initially installed on the container.

6. The capping system of claim 1, further comprising a stopper inserted into the mouth of the container and disposed between the mouth and said bottom of said cap.

7. The capping system of claim 1, wherein said guarantee ring includes at least one cut that facilitates severing of said guarantee ring.

8. A capping system in combination with a container having a mouth and a wall segment, the capping system comprising:

a cap including a bottom for selectively covering the mouth, a jacket extending from said bottom, and a guarantee ring disposed at a distal edge of said jacket, said guarantee ring connected to said jacket via a predetermined rupture line; and at least one cam extending from an outer surface of the wall segment, at least partially overlapped by said guarantee ring, and including at least one engagement surface applying a force on said guarantee ring when said cap is rotated a predetermined distance relative to the container to at least partially sever said guarantee ring in a direction substantially perpendicular to said predetermined rupture line;

wherein said at least one engagement surface is spaced apart from a surface of said guarantee ring when said cap is initially installed on the container; and wherein said guarantee ring includes a first wall thickness and a second wall thickness less than said first wall thickness, said at least one engagement surface applying a force on said second wall thickness of said guarantee ring to apply a force on said guarantee ring when said cap is rotated relative to the wall segment in either a first direction or a second direction.

9. The capping system of claim 8, wherein said guarantee ring includes an edge bent toward the outer surface of the wall segment and a flanged region providing clearance for said cam when said cap is initially installed on the container, said bent edge being disposed adjacent to at least one of a first end and a second end of said flanged region and engaging said cam when said cap is rotated relative to the wall segment.

10. The capping system of claim 9, wherein said bent edge extends around a perimeter of said guarantee ring between said first end of said flanged region and said second end of said flanged region.

11. The capping system of claim 9, wherein said at least one engagement surface includes at least one sloped surface, said at least one sloped surface engaging said bent edge of said guarantee ring to apply a force on said guarantee ring when said cap is rotated relative to the wall segment.

12. A capping system in combination with a container having a mouth and a wall segment, the capping system comprising:

a cap including a bottom for selectively covering the mouth, a jacket extending from said bottom, and a guarantee ring disposed at a distal edge of said jacket, said guarantee ring connected to said jacket via a predetermined rupture line; and at least one cam extending from an outer surface of the wall segment, at least partially overlapped by said guarantee ring, and including at least one engagement surface applying a force on said guarantee ring when said cap is rotated a predetermined distance relative to the container to at least partially sever said guarantee ring in a direction substantially perpendicular to said predetermined rupture line;

wherein said at least one engagement surface is spaced apart from a surface of said guarantee ring when said cap is initially installed on the container;

wherein said guarantee ring includes a first wall thickness and a second wall thickness less than said first wall thickness, said at least one engagement surface applying a force on said second wall thickness of said guarantee ring to apply a force on said guarantee ring when said cap is rotated relative to the wall segment in either a first direction or a second direction;

wherein said guarantee ring includes an edge bent toward the outer surface of the wall segment and a flanged region providing clearance for said cam when said cap is initially installed on the container, said bent edge being disposed adjacent to at least one of a first end and a second end of said flanged region and engaging said cam when said cap is rotated relative to the wall segment; and wherein said at least one engagement surface includes a pair of sloped surfaces disposed at opposite ends of said cam, said sloped surfaces engaging said bent edge of said guarantee ring to apply a force on said guarantee ring when said cap is rotated relative to the wall segment in either a first direction or a second direction.

13. The capping system of claim 8, further comprising a stopper inserted into the mouth of the container and disposed between the mouth and said bottom of said cap.

14. The capping system of claim 8, wherein said guarantee ring includes at least one cut that facilitates severing of said guarantee ring.

* * * * *